US005661982A

United States Patent [19]

Bae et al.

[11] Patent Number: 5,661,982

[45] Date of Patent: Sep. 2, 1997

[54] ELECTRONIC REFRIGERANT COMPRESSOR FOR A COOLING SYSTEM

[75] Inventors: Young-Dawn Bae, Suwon; Dong-Yul Nam, Seoul, both of Rep. of Korea

[73] Assignee: SamSung Electronics Co., Ltd., Suown, Rep. of Korea

[21] Appl. No.: 352,063

[22] Filed: Nov. 30, 1994

Related U.S. Application Data

[63] Continuation-in-part of Ser. No. 515,748, Apr. 30, 1990, abandoned.

[30] Foreign Application Priority Data

May 1, 1989 [KR] Rep. of Korea ..... 5811/1989

[51] Int. Cl.[6] ..... F25B 15/00; F25B 17/00

[52] U.S. Cl. ..... 62/106; 62/148; 62/477

[58] Field of Search ..... 62/144, 148, 477, 62/106

[56] References Cited

U.S. PATENT DOCUMENTS

| | | | |
|---|---|---|---|
| 2,276,947 | 3/1942 | Kleen | 62/144 |
| 2,513,148 | 6/1950 | Coons | 62/144 |

OTHER PUBLICATIONS

Refrigeration and Air conditioning; Jordan & Priester Prentice–Hall, Inc 1948 pp. 238, 239, 242–244.

Applications of Thermodynamics; Wood; Addison–Wesley Pub. Co. 1982.

*Primary Examiner*—William E. Wayner

*Attorney, Agent, or Firm*—Robert E. Bushnell, Esq.

[57] ABSTRACT

An electronic refrigerant compressing apparatus comprises two or more compressing portions coupled in parallel to one another, which repeats the heating and cooling of the refrigerant circulating the refrigerant cycle at an interval of a predetermined time. Each of the compressing portions is provided with the cylindrical body having the refrigerant charged therein, the refrigerant pipe coiled around its body, the refrigerant heating load mounted in close to the refrigerant pipe for increasing the pressure of the refrigerant, the solenoid valve mounted at the inlet and outlet if the refrigerant, which is opened/closed according to the control of the microcomputer and means for detecting the temperature of the refrigerant, in which one side of the body and the refrigerant pipe is connected through the solenoid valve and the refrigerant outlet to the condenser as part of the refrigerant cycle, and the other side is connected through the check valve to the evaporator. Otherwise, the microcomputer controls the operations for the solenoid valve and the load depending upon the signal for the detecting means so that a plurality of compressing portions perform the compressing operation in turn at the predetermined interval.

10 Claims, 12 Drawing Sheets

P-H DIAGRAM OF AMMONIA

P-H DIAGRAM OF WATER

ELECTRONIC REFRIGERANT COMPRESSOR FOR A COOLING SYSTEM

CROSS-REFERENCE TO RELATED APPLICATIONS

This application makes reference to, incorporates herein and claims all benefits available under 35 U.S.C. §§119 and 120 from our application entitled *An Electronic Type Refrigerant Compression System* earlier filed in the Industrial Property Office of the Republic of Korea on 1 May 1989 and then assigned Ser. No. 1989/5811. This application is a continuation-in-part application of the patent application entitled *An Electronic Type Refrigerant Compression System* earlier filed in the U.S. Patent & Trademark Office on 30 Apr. 1990 and then assigned Ser. No. 07/515,748.

BACKGROUND OF THE INVENTION

The invention is related to providing an electronic type refrigerant compressor for compressing the refrigerant in apparatus such as an air conditioner, an industrial air conditioning apparatus, or a refrigeration system.

There have been various types of the reciprocal system and the rotary system for forcing the refrigerant to be compressed by a compressing motor, and an absorption system for heating the refrigerant by burning fuel, such as gas, etc. and then compressing by the compressor.

But the reciprocal system has not been able to change the pressure of the refrigerant since its compression capacity is defined as the predetermined constant value, and also it is very difficult to install and move due to its heavy weight as well as its large volume. The rotary system is relatively expensive, so that it causes cost increase of appliances using the rotary system and it requires large investment in constructing its manufacturing facility. Also, both the reciprocal system and the rotary system force the refrigerant to be compressed by using a compressing motor. Due to this use of the compressing motor it has the problem of generating a roaring sound during operation of the compressing motor. A known absorption system has problems in that its compression efficiency is bad and its volume is large, and refrigerant, which is heated by a fuel such as gas on circulation, may accidentally explode and generate an exploding noise.

On the other hand, in a freezing cycle system, a compressor has been provided with a heater, integrally, in order to resolve said problems. Such a compressor is generally operated with a heater for heating the refrigerant stored in its compressing portion and then cools the refrigerant to be compressed. Thus it successfully accomplished reducing its weight and simplifying configuration, thereby facilitating its installation and movement. If numerous compressors are used in one system, however, this system has problems in that the compressing efficiency of the refrigerant is significantly decreased because of cooling pipes mounted on the compressing portion except for the refrigerant stored in the compressing portion. Also it must be provided with a refrigerant tank for storing additional refrigerant, thereby increasing the volume of the system, and if the difference between the thermal conductivities of the compressors occurs, the refrigerant flows backward.

The conventional typical art was disclosed in Japan Laid Open Publication No. Sho 58-224272 titled "A driving control system of a refrigerator". This system comprises multi compressor units, at least one electronic opening/closing valve for the driving control of each of the compressor units, at least one pressure sensor for sensing the intake pressure to determine the dimension of the freezing load, and inputting portion for setting various parameters of a pressure value from the outdoor and an operating mode, etc., an operating panel provided with a digital switch, a displaying portion for representing the operating time, an electronic valve mounted as a part of the high temperature gas circuit if a defrost operation is performed and a microcomputer for controlling multiple compressors. When the microcomputer receives, as input signals, setting values having upper and lower limits of intake pressures and a differential setting value based on the fluctuation width of a cooling load and a number of compressors, it allocates uniformly cut in and cut out operating pressures and the step differences between mutual operating pressures to each of the compressor, and then computes said allocated values and memorizes them. Thereafter it compares each of said memorized values with a detected values of each of said intake pressures to supply the operating control signal to each of the compressors.

Such a conventional system can control the capacity of multiple compressor units according to the fluctuation of a freezing load, with respect to controlling each of the intake pressures in multiple compressors during freezing cycles, but it does not mention the configuration of a plurality of a compressing portions provided with a heating portion, respectively, as well as the function performed so that the compression and heat operations of each compressing portions are controlled in turn basing the refrigerant heating on the time and the temperature according to setting of the pressures. As a result, each of the compressing portions has the defects the same as those of the prior arts.

SUMMARY OF THE INVENTION

According, the object of the invention is to provide an electronic refrigerant compressing apparatus for increasing the compressing force of the refrigerant as well as its compressing efficiency in an absorption system.

Another object of the invention is to provide an electronic refrigerant compressing apparatus for adjusting the compressing of the refrigerant, spontaneously.

Another object of the invention is to provide an electronic refrigerant compressing apparatus for preventing the reverse flow of the refrigerant and for smoothly circulating the refrigerant during the cooling cycle.

Another object of the invention is to provide a method for controlling a refrigerant compressing apparatus provided with a plurality of compressing portions connected in parallel to one another for heating/cooling the refrigerant in each of compressing portions at the predetermined interval to increase its pressure, thereby enhancing the compressing force and efficiency of the refrigerant as well as preventing the reversing flow of the refrigerant.

Specifically, the invention adjusts the heating calorie mount of the refrigerant to control the raise and drop of its temperature, thereby adjusting the compressing force of the refrigerant, and further the invention controls the temperature of the refrigerant to be discharged into the cooling cycle or adjusts the number of compressing portions to regulate the compressing degree of the refrigerant.

Thus, the invention comprises two or more compressing portions coupled in parallel to one another, which repeats the heating and cooling of the refrigerant circulating during the cooling cycle interval of a predetermined time. Each of the compressing portions is provided with a cylindrical body having the refrigerant charged therein, a refrigerant pipe coiled around its body, a refrigerant heating load mounted close to the refrigerant pipe for increasing the pressure of the refrigerant, check valves mounted at inlets to the compressing portions and solenoid valves mounted at outlets of the compressing portions, the solenoid valves being opened or closed according to the control of the microcomputer and means for detecting the temperature of the refrigerant in the compressing portions, the output sides of the cylindrical bodies and the refrigerant pipes are connected through the solenoid valves to a refrigerant output portion and further to a single input of the condenser as the part of the cooling cycle, and the input side of the cylindrical bodies and the refrigerant pipes are connected through check valves to a single output of the evaporator. The microcomputer controls the operations of the solenoid valves and the loads depending upon the signal of the detecting means so that a plurality of compressing portions perform the compressing operation in turn, i.e., sequentially, during the predetermined interval.

Also, the invention is related to a method for controlling the electronic compressing apparatus. Firstly, the compressing portions are operated to heat the refrigerant in the bodies and the pipes and increase the refrigerant pressure. The microcomputer detects the temperature of the heated refrigerant based on the detecting signals of the temperature detecting sensor. When the refrigerant temperature is increased up to the predetermined temperature, the microcomputer opens the solenoid valve of the cylindrical body till the temperature of the refrigerant reaches the next predetermined temperature, so that the refrigerant compressed in the cylindrical body is circulated into the cooling cycle system. Then, the solenoid valve is dosed while the load is stopped. After a predetermined period, the solenoid valve of the refrigerant pipe is opened to circulate the refrigerant compressed in the pipe into the cooling cycle. On the other hand, the refrigerant is again introduced into the cylindrical body and the refrigerant pipe and repeats the operation as described above. Therefore, such an operation is repeated at the predetermined interval in each of the compressing portions, thereby enhancing the compressing efficiency of the absorption system.

Also, the invention is provided with the solenoid valves mounted at the compressing portions outlets, which are opened/closed by the control of the microcomputer and the check valves mounted at the compressing portions inlets to prevent the reversing flow of the refrigerant as well as to smoothly recharge the compressing portions with refrigerant during the cooling cycle.

BRIEF DESCRIPTION OF DRAWINGS

The above and other objects of the invention will be seen by reference to the description taken in connection with the accompanying drawings, in which.

DETAIL DESCRIPTION OF INVENTION

Figure 1:
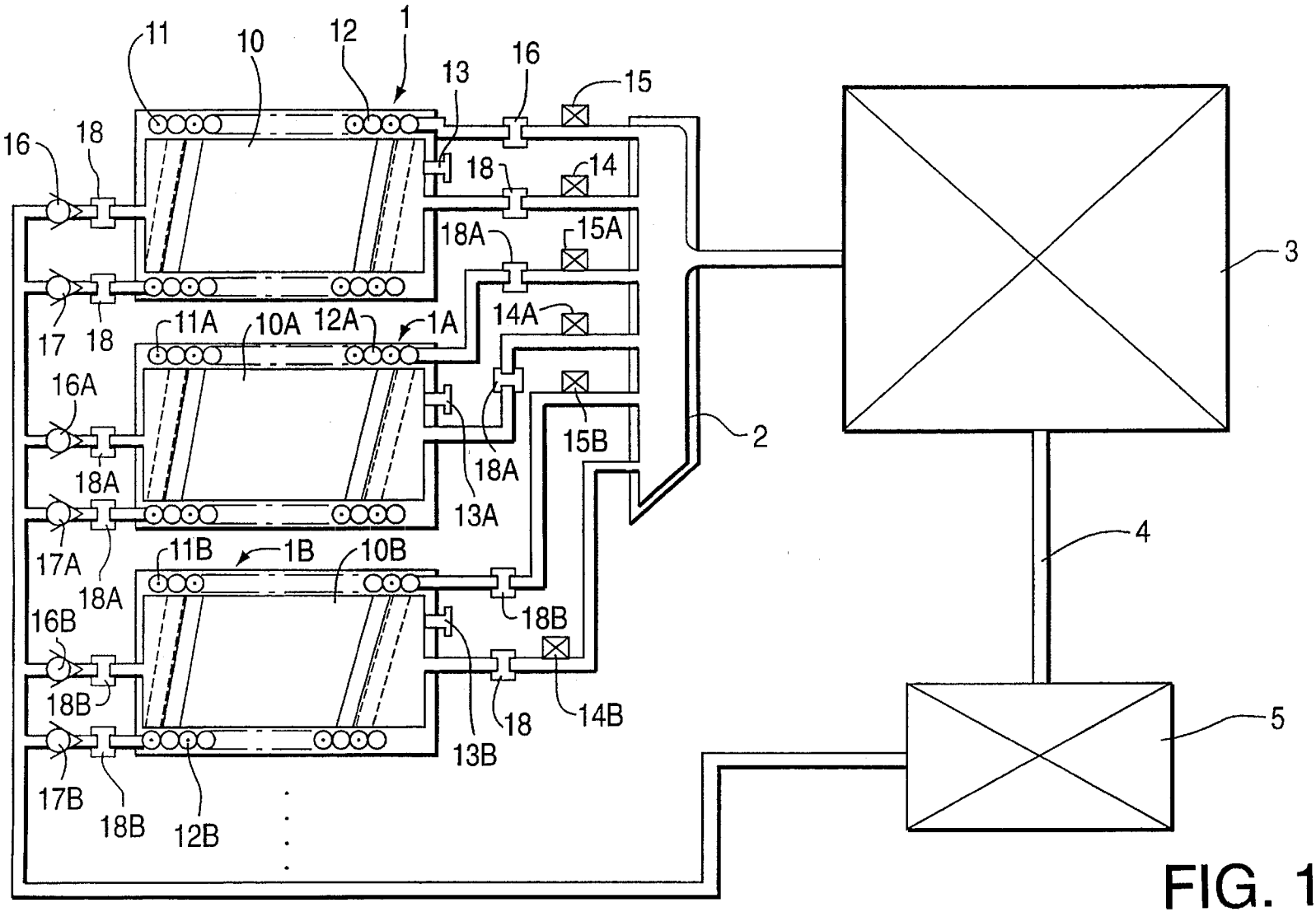
FIG. 1 is a cross sectional view illustrating one embodiment of the electronic refrigerant compressing apparatus according to the invention.

FIG. 1 shows a cross sectional view of one embodiment of the electronic refrigerant compressing apparatus which is provided with three compressing portions according to the invention.

A plurality of compressing portions 1, 1A and 1B, for heating or cooling the refrigerant are connected in parallel to one another, the number of which may spontaneously be determined according to the compressing force of the refrigerant. Each of compressing portions 1, 1A and 1B includes cylindrical bodies 10, 10A and 10B, respectively, with the refrigerant being charged therein, and refrigerant pipes 12, 12A and 12B also having refrigerant charged therein. The heaters controlled by the microcomputer are first load 11, second load 11A and third load 11B, each being respectively wound around the outer wall of each of the cylindrical bodies 10, 10A, 10B in the threaded form and being closely contacted with refrigerant pipes 12, 12A, 12B, respectively. Temperature detecting sensors 13, 13A and 13B for detecting the temperature of the refrigerant in each of the compressing portions 1, 1A and 1B are respectively secured to one side of the cylindrical bodies 10, 10A and 10B. The refrigerant outlets, which are respectively formed at one end of the cylindrical bodies 10, 10A, 10B and refrigerant pipes 12, 12A, 12B, are coupled with refrigerant output portion 2, respectively, via solenoid valves 14, 14A, 14B and 15, 15A, 15B controlled by the microcomputer. Refrigerant output portion 2 has a plurality of input openings connected to the refrigerant outlets of the compressing portions and provides the refrigerant to a single outlet connected to an input of condenser 3. In the cooling cycle the refrigerant is circulated in turn from the compressing portions 1, 1A and 1B through a condenser 3, capillary tube 4 and evaporator 5, and the refrigerant is then returned to the compressing portions. Refrigerant inlets, which are respectively formed at the other sides of the cylindrical bodies 10, 10A, 10B and refrigerant pipes 12, 12A, 12B, are commonly connected to the output of evaporator 5, via respective check valves 16, 16A, 16B and 17, 17A, 17B. An insulative material 18, 18A, 18B such as the robber packing, etc. is installed in an insulative relationship between cylindrical bodies 10, 10A, 10B and solenoid vales 14, 14A, 14B, and between refrigerant pipes 12, 12A, 12B and solenoid vales 15, 15A, 15B. Also, the insulative material 18, 18A, 18B is installed in an insulative relationship between cylindrical bodies 10, 10A, 10B and check valves 16, 16A, 16B and between cylindrical bodies 10, 10A, 10B and check valves 17, 17A, 17B to prevent heat from being transferred between parts.

Figure 6A:
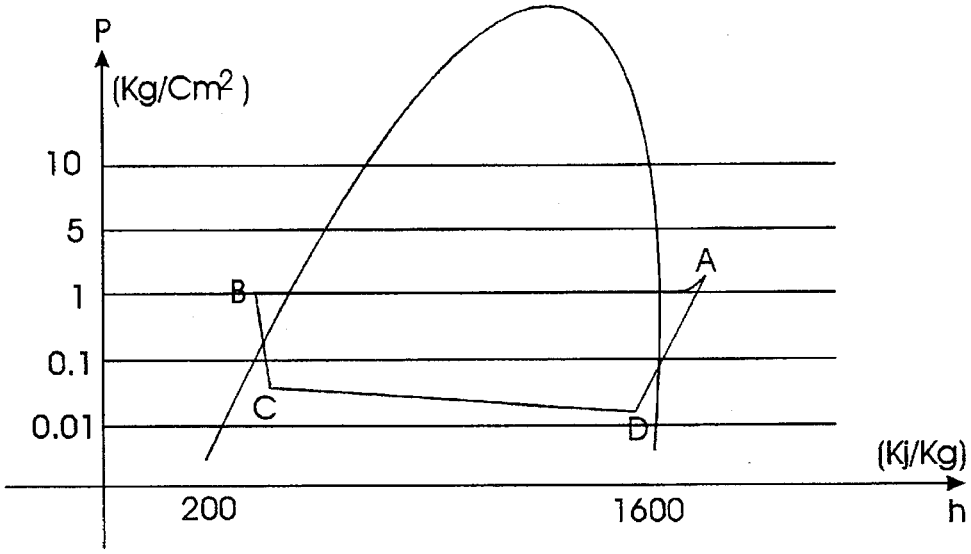
FIGS. 6A and 6B illustrate the pressure-enthalpy diagrams and cooling cycles for the preferred refrigerants used in the invention.
Figure 6B:
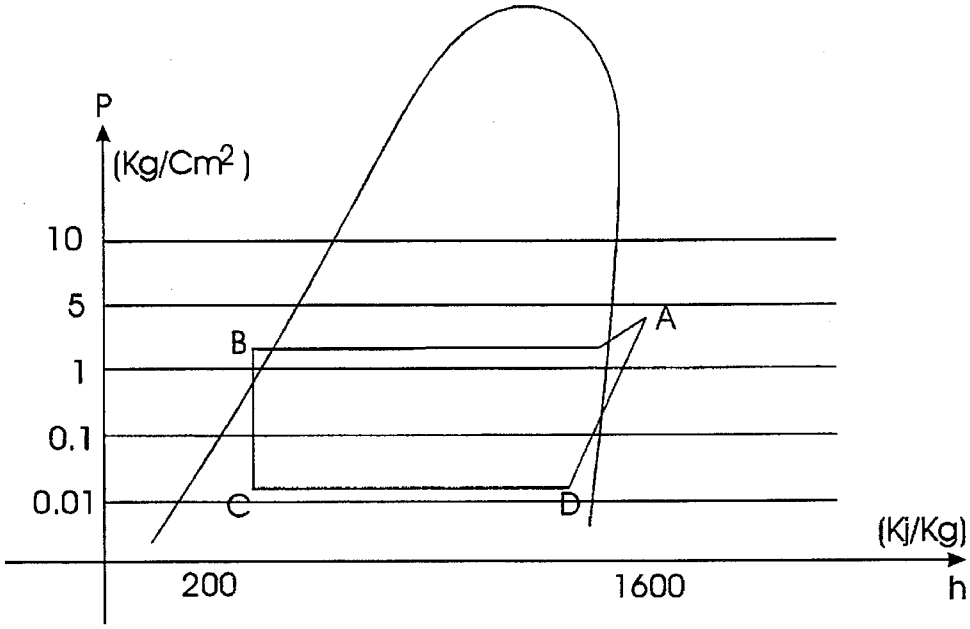

The inventive electronic compressing apparatus is usable in conventional systems having a compressor, capillary tube and evaporator in the cooling cycle, by using a refrigerant-absorbent ammonia and combination of water. FIG. 6A is an pressure-enthalpy diagram for ammonia and FIG. 6B is an pressure-enthalpy diagram for water according to the present invention, wherein the area DABC represents the cooling cycle. In both FIGS. 6A and 6B the segment DA represention the compression during which the refrigerant is heated. At state A, the vapor passes to the condenser 3 and is cooled at nearly constant pressure and condensed as indicated by segment AB. The segment BC is indicative of when the condensed liquid passes through the capillary tube 4, and segment CD represents when the mixture of liquid and vapor, from the capillary tube 4, absorbs heat in the evaporator 5 and vaporizes to be passed back into the compressor to begin the cooling cycle again.

Figure 2:
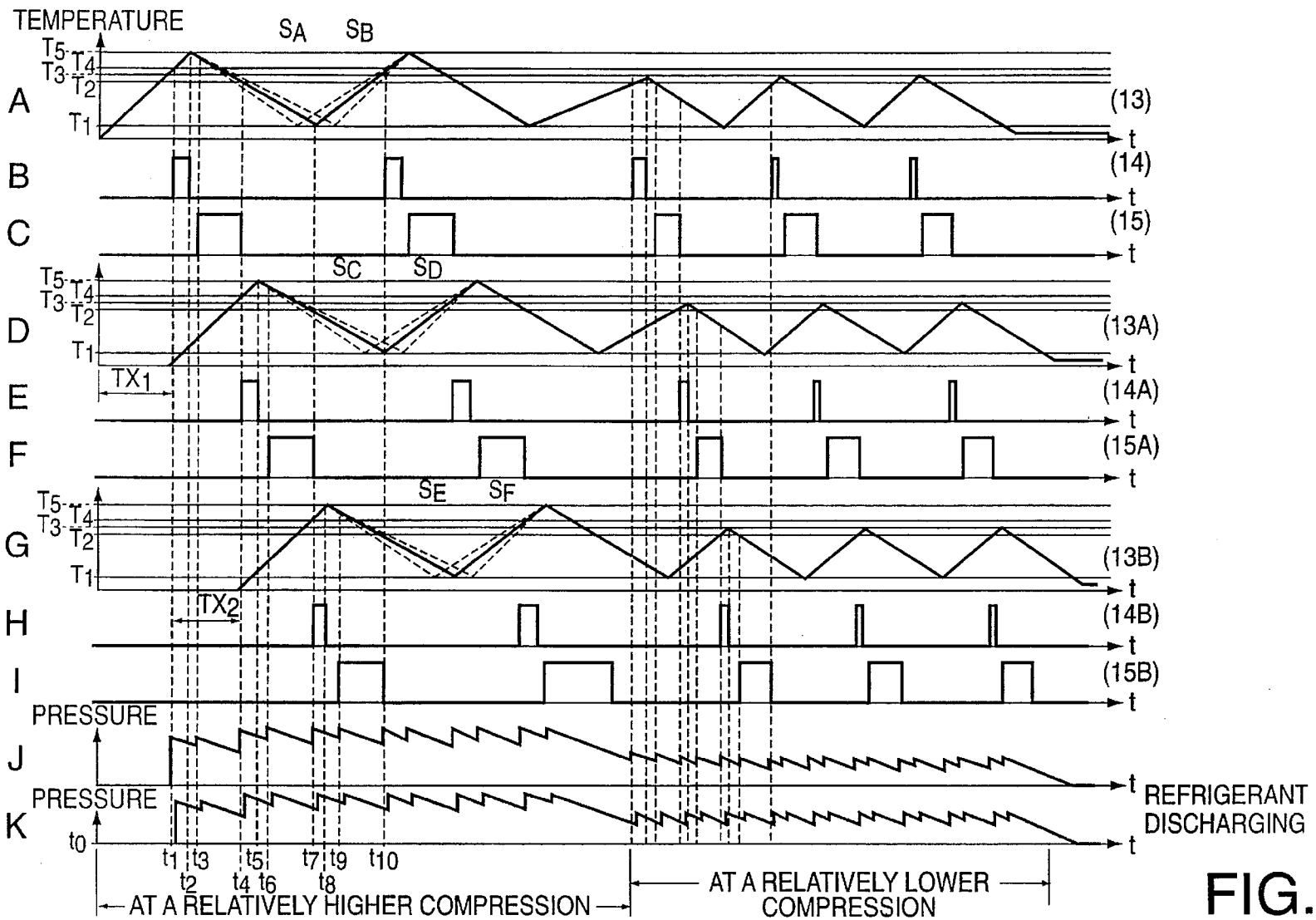
FIG. 2 exhibit waveforms A–K illustrating the operation of the invention.

Therefore, as illustrated in FIG. 2, the electronic refrigerant compressing apparatus of the invention is operated as follows:

When the refrigerant, e.g. ammonia, is going to be compressed, the microcomputer controls the first load 11 of compressing portion 1 to force it to be heated at the time of $t_0$. The refrigerant stored in cylindrical body 10 and refrigerant pipe 12 is heated to increase its pressure. Note that the initial temperature and pressure are $T_i$ and $P_i$ prior to heating (the temperature and pressure being based on the saturated vapor condition of the refrigerant used). In the compressor, heat is applied as work by the load 11. Since the compressor is a closed vessel and the temperature of the refrigerant in the compressor will increase due to the heat applied, then the pressure of the refrigerant in the compressor will increase proportionally with the increase in temperature. As heat is applied from load 11 the temperature is increased to $T_f$ and the pressure $P_f$ is increased to $T_fP_i/T_i$. The microcomputer detects the refrigerant temperature on the basis of the detecting signal of sensor 13. At this time, the refrigerant is not reversed at the inlets of cylindrical body 10 and refrigerant pipe 12 because of check valves 16, 17 mounted thereto. Further, the refrigerant remains in the compressing portions cylindrical body 10 and refrigerant pipe 12 since solenoid valves 14, 15 are controlled by the microcomputer to keep closed until a desired temperature, and therefore a desired pressure, of the refrigerant within the cylindrical body 10 is detected. Thus the refrigerant is heated to heighten its pressure according to the heating of the first load 11 with the refrigerant being stored in the cylindrical body 10 and refrigerant pipe 12.

Temperature detecting sensor 13 detects the refrigerant temperature in compressing portion 1. When the refrigerant temperature of a predetermined temperature T4 is reached, the microcomputer operates solenoid valve 14 to be opened on the basis of the detecting signal of sensor 13 as shown in FIG. 2B, so that the refrigerant having increased pressure is discharged through solenoid valve 14 into the refrigerant output portion 2 while first load 11 continues to heat the refrigerant.

As the refrigerant temperature is increased by the constant temperature T5, after the predetermined time of $t_2$ has been passed, solenoid valve 14 is closed to cut off the further discharging of the refrigerant in cylindrical body 10 while first load 11 stops the heating of the refrigerant. Then solenoid valve 15 is opened, under control of the microcomputer, to discharge the compressed refrigerant in refrigerant pipe 12 into the refrigerant portion 2 during the period of $t_3$ to $t_4$ as shown in FIG. 2C.

As the refrigerant compressed by the high pressure in cylindrical body 10 and refrigerant pipe 12 is discharged as a vapor into refrigerant output portion 2, the pressure of the refrigerant in refrigerant output portion 2 is increased, and this refrigerant flows via condenser 3, capillary 4 and evaporator 5 comprising further parts of the cooling cycle system to check valves 16, 17, respectively, installed on the inlet sides of cylindrical body 10 and refrigerant pipe 12. At this time, the refrigerant pressure at the inlets is increased to open check valves 16, 17 as shown in FIG. 2J, since the pressure of the refrigerant inside the cylindrical body 10 and refrigerant pipe 12 is less than the pressure at the inlets thereof. Subsequently, the refrigerant cooled by passing through the cooling cycle system is reintroduced into cylindrical body 10 and refrigerant pipe 12, and the refrigerant temperature is lowered as shown in FIG. 2A. As a consequence, the refrigerant temperature in compressing portion 1 is lowered below the predetermined temperature T1 after the constant time of $t_7$ has been passed. The invention then repeats the above operation at the beginning of heating of first load 11 to compress the refrigerant.

Compressing portions 1A, 1B are controlled, in turn, at the predetermined intervals $TX_1$, $TX_2$, respectively, after the initializing of compressing portion 1 as described above.

Assuming that three compressing portions 1, 1A, 1B are connected in parallel to one another, second load 11A of compressing portion 1A is operated to heat the refrigerant in cylindrical body 10A and refrigerant pipe 12A at the time of $t_1$, i.e. when solenoid valve 14 is opened to exhaust the vapor from cylindrical body 10, as shown in FIG. 2D. Following that, solenoid valve 14A is opened to exhaust the refrigerant from cylindrical body 10A at time $t_4$, the time from $t_4$ to $t_5$ being set to close solenoid valve 15, while solenoid valve 14A is opened to discharge the refrigerant in cylindrical body 10A, and the heating of second load 11A is stopped at $t_5$ as shown in FIG. 2E. Thereafter, solenoid valve 15A is opened to exhaust the vapor in refrigerant pipe 12A from $t_6$ to $t_{10}$. The invention then repeats the above operation at the beginning of heating of first load 11A to compress the refrigerant.

On the other hand, third load 11B of compressing portion 1B is operated to heat the refrigerant in cylindrical body 10B and refrigerant pipe 12B at $t_4$, when solenoid valve 14A is opened, as shown in FIG. 2G. Subsequently solenoid valve 14B is opened to discharge the compressed refrigerant from cylindrical body 10B at time $t_7$, the time from $t_7$ to $t_8$ being set to close solenoid valve 15A as shown in FIG. 2H. At $t_8$ the operation of third load 11B is stopped and then solenoid valve 15B is opened to exhaust the vapor from refrigerant pipe 12B from $t_9$ to $t_{12}$ to repeat the above operations. The invention then repeats the above operation at the beginning of heating of first load 11B to compress the refrigerant.

That is to say, the refrigerant compressing apparatus according to the invention is operated as follows:

First load 11, second load 11A and third load 11B in each of compressing portions 1, 1A, and 1B begin to heat the refrigerant at times $t_0$, $t_1$ and $t_4$, respectively, to force the pressure of the refrigerant in the compressing portions 1, 1A and 1B to be increased in turn. As the refrigerant is increased over a predetermined temperature T4, solenoid valves 14, 15, 14A, 15A, 14B, 15B are opened in turn to exhaust the refrigerant from compressing portions 1, 1A, 1B. The exhausted refrigerant is circulated through condenser 3, capillary tube 4 and evaporator 5 and then passed through check valve 16, 17, 16A, 17A, 16B, 16C to be introduce back into compressing portions 1, 1A, 1B, thereby repeating the cooling operation. Due to the continued supply of vapor from the respective compressing portions, the pressure of the refrigerant at the condenser 3 is maintained nearly constant as shown in waveforms J and K in FIG. 2. Condenser 3 is such that if more vapor is entering the condenser as the vapor condenses and drains as a liquid, the density, pressure, and saturation temperature of the vapor will remain nearly constant and condensation will continue as long as heat is continuously extracted from the vapor, see, for example, *Principles of Refrigeration* by Roy J. Dosset (John Wiley & Sons, Inc., New York and London, 1961), section 4–13 on page 49. Accordingly, since there is a continued supply of vapor from compressing portions 1, 1A and 1B, sequentially, the pressure of the refrigerant at the condensor 3 is maintained.

In addition to compressing the refrigerant using three compressing portions as described above, the invention uses as plurality of compressing portions connected in parallel to one another to compress the refrigerant more than when using three compressing portions. Of the operations of solenoid valves 14, 14A, 14B and 15, 15A, 15B and loads 11, 11A 11B are controlled according to the temperature T3, T4 instead of the temperature T4, TS, the refrigerant can be compressed in a relative weak state. Also, the invention controls the calorie amount of loads 11, 11A, 11B while heating and cooling the refrigerant based on the temperature curves SA, SB, SC, SD, SE, SF, in FIG. 2, to adjust the compressing force.

Figure 3:
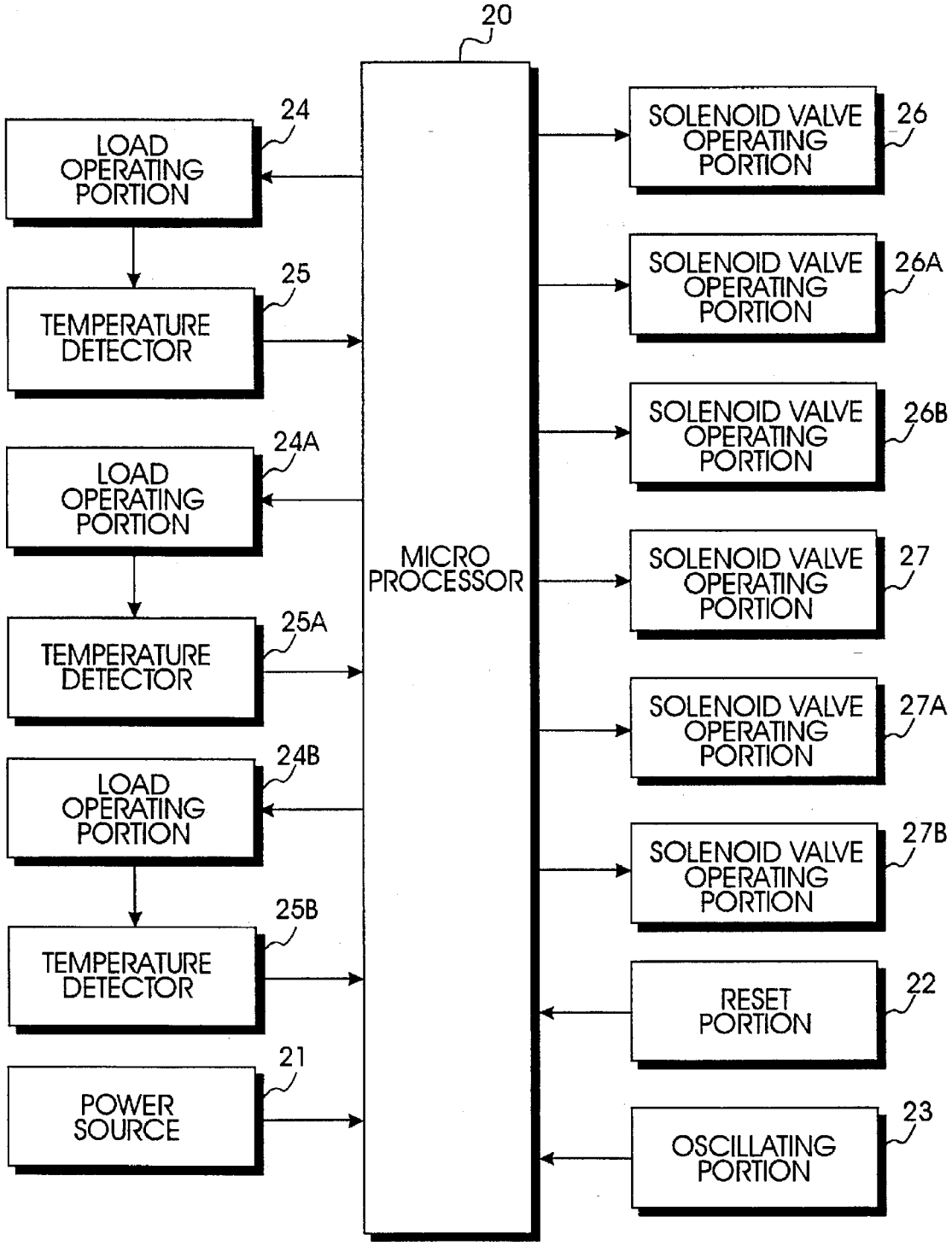
FIG. 3 is a control circuit of the electronic refrigerant compressing portion performing the control method of the invention.

FIG. 3 is a control circuit of an electronic refrigerant compressing apparatus according to a control method of the invention.

The invention comprises microcomputer 20 for controlling every operation of an electronic refrigerant compressing apparatus, power source 21 for supplying the power voltage, reset portion 22 for initializing the microcomputer 20, oscillating portion 23 for feeding the clock pulse to the microcomputer 20, load operating portions 24, 24A, 24B for respectively forcing first load 11, second load 11A and third load 11B to be heated according to the control of microcomputer 20, refrigerant temperature detecting portions 25, 25A, 25B for respectively detecting the refrigerant temperatures of compressing portions 1, 1A, 1B on the basis of the heating of first, second and third loads 11, 11A, 11B and inputting the detecting signals to the microcomputer 20, respectively, and solenoid valve operating portions 26, 26A, 26B, 27, 27A, 27B for exhausting the refrigerant having the increased pressure which was increased in cylindrical bodies 10, 10A, 10B and refrigerant pipes 12, 12A, 12B with solenoid valves 14, 14A, 14B, 15, 15A, 15B being operated according to the control of the microcomputer 20, through refrigerant output portion 2.

Figure 4A:
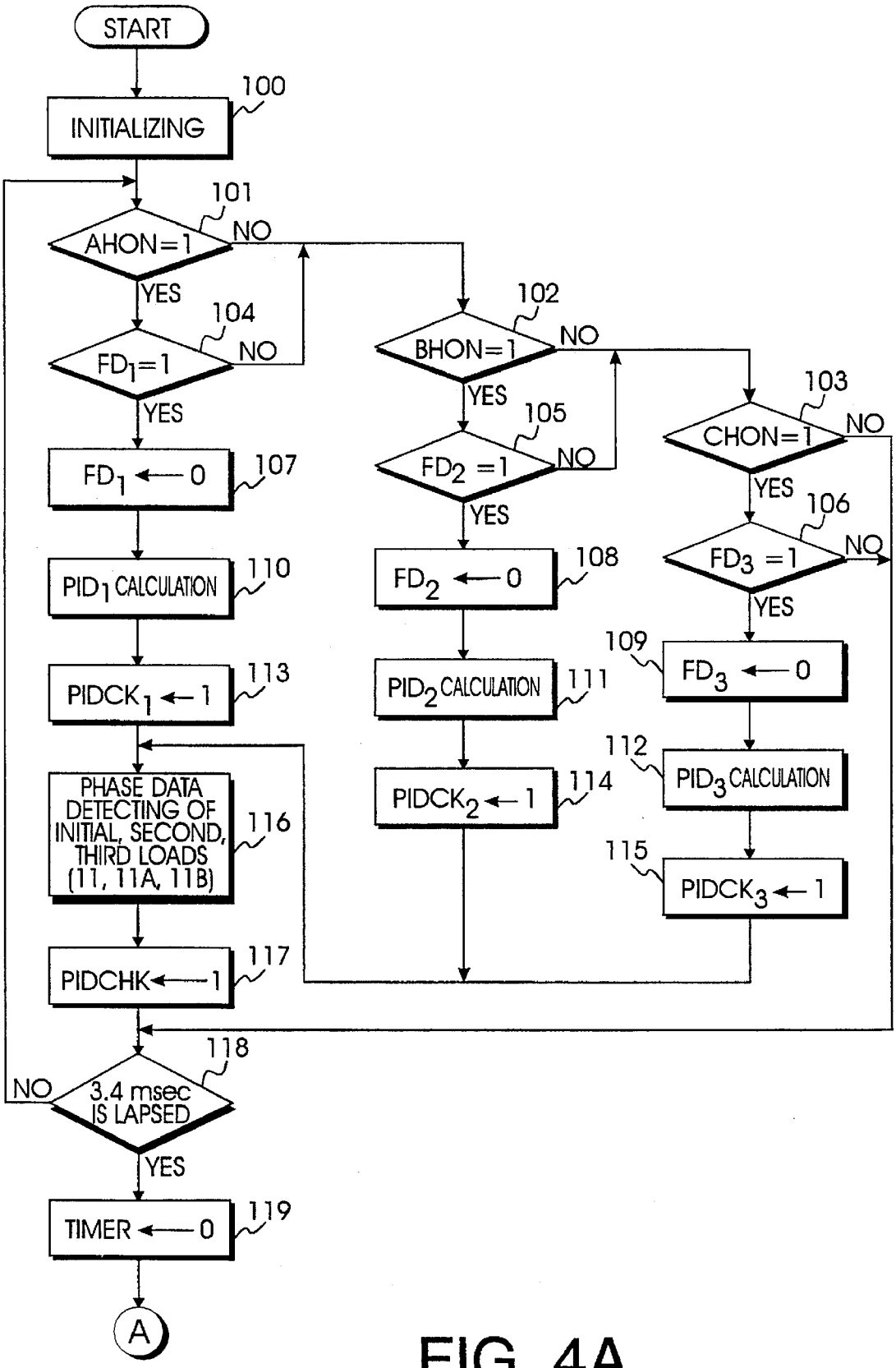
FIGS. 4A to FIG. 4G are a flow chart illustrating the control method of the invention.
Figure 4B:
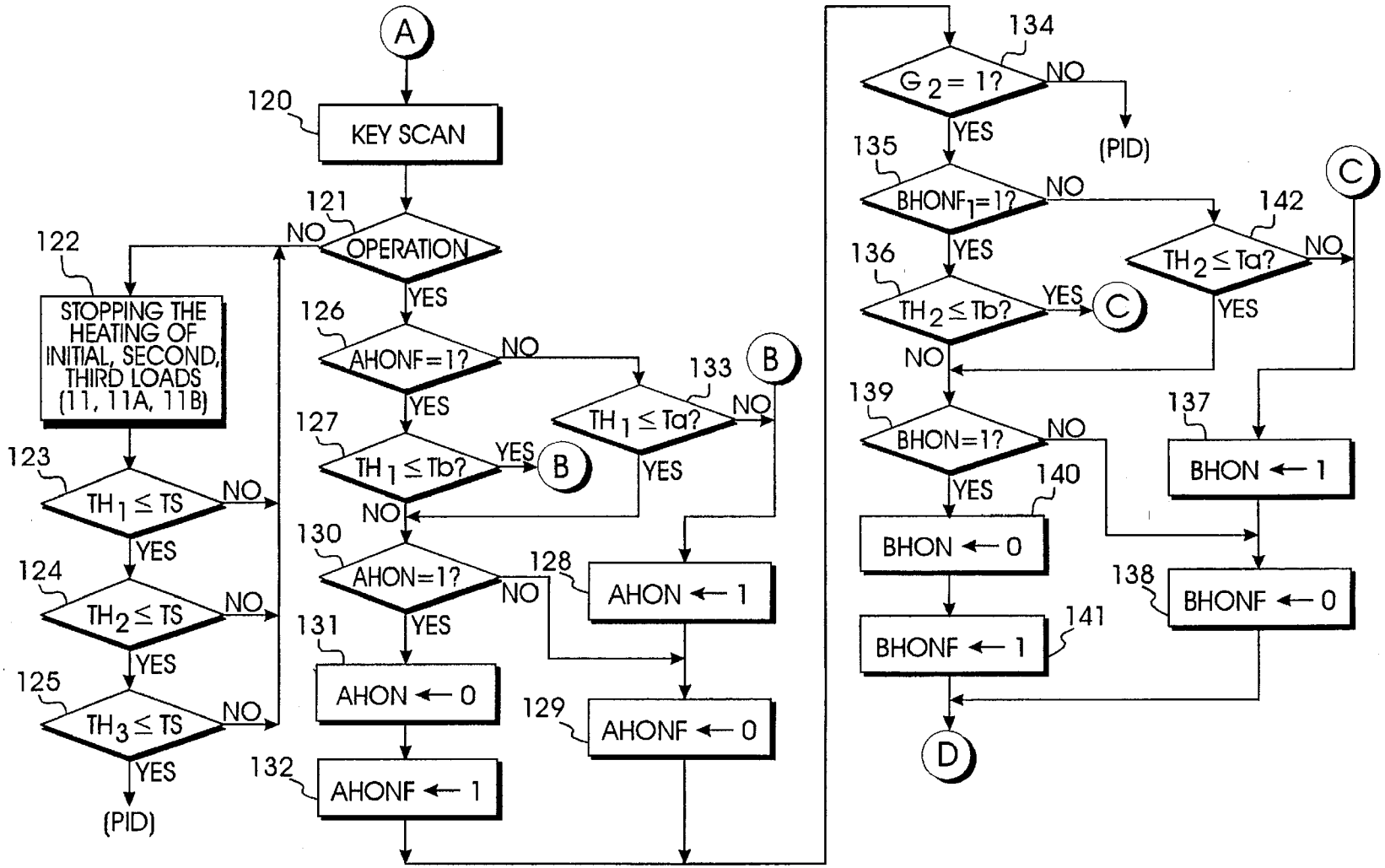
Figure 4C:
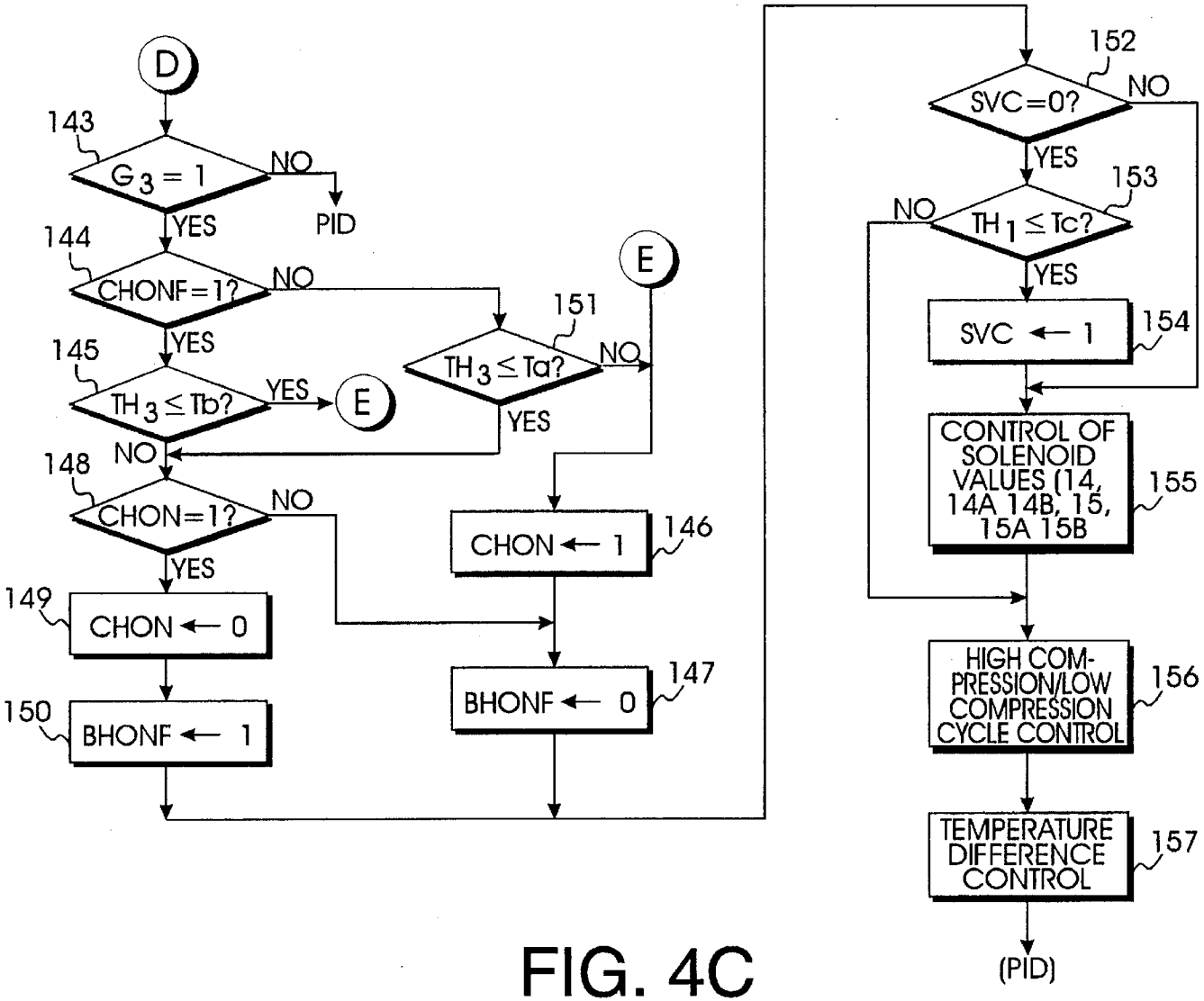

Thus, the method of the invention comprises steps as shown in FIGS. 4A–4C, as discussed below.

As shown in FIG. 4A, the microcomputer 20 is initialized at step 100. At this time, the microcomputer 20 receives the external interrupt and clock interrupt signals to compute the PID (i.e., proportional integral derivative) of the first load 11, second load 11A and third load 11B. At steps 101–103, each of the heating flags AHON, BHON, CHON associated with the first load 11, second load 11A and third load 11B is set to judge whether any of the first load 11, second load 11A or third load 11B is being heated. If the heating operation is being performed, temperature detecting flags FD1, FD2, FD3 are set to judge whether the refrigerant temperatures of compressing portions 1, 1A, 1B are detected at every predetermined times according to the heating operations of the first load 11, second load 11A, third load 11B at steps 104–106. If the refrigerant temperatures are detected, temperature detecting flags FD1, FD2 and FD3 are reset at steps 107–109. At steps 110–112, PIDs PID1–PID3 of the first load 11, second load 11A, third load 11B are respectively calculated, and then, at steps 113–115 PID flags PIDCK1, PIDCK2 and PIDCK3 of the three loads are set. At step 116, the phase data of the three loads are detected, and at step 117 phase data detecting flag PIDCHK is set at 1. At step 118, there is judged whether 3.4 msec has lapsed, otherwise said operations are again returned to step 101 to achieve the initializing. That is to say, the calculation of PID corresponding to each of loads 11, 11A, 11B is performed at the cycle of 3.4 msec to detect their phase data.

Thereafter, when the time of 3.4 msec is passed, the internal timer is set at 0 at step 119 to go on step 120, FIG. 4B, for scanning the keys. At step 121 it is judged whether the operation of each of loads is being executed, otherwise the heating of each of the loads 11, 11A, 11B is stopped at step 122, and then the microcomputer 20 is alternatively moved into steps 123 to 125 to judge whether the refrigerant temperatures TH1, TH2, TH3 of compressing portions 1, 1A, 1B are below the specific temperature Ts based on the detecting signal of the temperature detecting sensors 13, 13A, 13B and performs the PID operation when the refrigerant temperature is below the specific temperature Ts.

On the other hand, when step 121 determines operation of the loads is being executed, it is judged whether first load 11 of compressing portion 1 stops its heating based on the heating stop flag ANOHF of the first load 11 at step 126. If the heating of the first load 11 is stopped with the first load heating stop flag ANOHF being set, it is judged whether the refrigerant temperature TH1 is less than or equal to the lowest temperature Tb at step 127. If the refrigerant temperature is judged as being less than or equal to the lowest temperature Tb step 127 goes on step 128 to heat the first load 11 with the first load heating flag AHON being set. Thereafter the first load heating stop flag AHONF is reset at step 129. If the refrigerant temperature TH1 is higher than the temperature Tb at step 127, step 128 goes on step 130 to check the heating of the first load 11. If the first load heating flag is not set to 1 to thereby indicate heating of the first load 11, the first load heating stop flag AHONF is reset at step 129. Otherwise if the first load heating flag is set to 1, which indicates heating of the first load 11, the first load heating flag AHON is reset at step 131 and then the first load heating stop flag AHONF is set at step 132 to stop the heating of the first load 11. And if the first load 11 is being heated with the first load heating stop flag AHONF being judged as not being set at step 126, it is judged whether the refrigerant temperature TH1 is greater than or equal to the maximum temperature Ta at step 133. If the refrigerant temperature TH1 is less than the maximum temperature Ta, first load heating flag AHON is set to continue to heat the first load 11 at step 128. Then at step 129 the first load heating stop flag AHONF is reset. On the contrary, if the refrigerant temperature TH1 is greater than or equal to the maximum temperature Ta, the state of the first load heating flag AHON is checked at step 130. If the first load 11 is not being heated, at step 129 the first load heating stop flag AHONF is reset. If the first load 11 is being heated, the first load heating flag AHON is reset at step 131, and the first load heating stop flag AHONF is set to stop the heating of the first load 1 at step 132.

Accordingly, if the refrigerant temperature TH1 of compressing portion 1 is over the maximum temperature Ta at step 126 to 133, the heating of the first load 11 is stopped. If the refrigerant temperature TH1 is below the maximum temperature Ta, the first load 11 is heated. If the first load 11 stops its heating, and the refrigerant temperature TH1 is at the lowest temperature Tb, the first load 11 is heated.

At step 134, following steps 129 or 132 discussed above, it is judged whether the predetermined time TX1 is lapsed, after the first load 11 is heated, by determing whether the time lapse flag G2 has been set, step 134. If the predetermined time TX1 is not passed, the microprocessor 20 performs the PID calculation. If the time TX1 is lapsed with the time lapse flag G2 being set, steps 135–142 are performed for the second load and compressing portion 1A, wherein steps 135–142 for the second load 11A and compressing portion 1A are similar to steps 126–133 for the first load 11 and compressing portion 1. If the refrigerant temperature TH2 of compressing portion 1A is judged to be higher than or equal to the maximum temperature Ta, step 142, the heating of the second load 11A is stopped, steps 139–141. If the refrigerant temperature TH2 is judged to be lower than the maximum temperature Ta, step 142, the second load 11A is heated, steps 137–138. When the heating of the second load 11A is stopped, step 135, the second load 11A is heated, steps 137–138, if the refrigerant temperature TH2 is judged to be less than or equal to the lowest temperature Tb, step 136.

Also, following steps 141 or 138, it is determined whether the predetermined time TX2 is passed, after the second load 11A is heated, by judging whether the time lapse flag G3 has been set, step 143, FIG. 4C. If the predetermined time TX2 has not lapsed, the microcomputer executes the PID operation. When the predetermined time TX2 is determined to have lapsed by determing the time lapse flag G2 has been set, steps 144–151 are performed for the third load 11B and third compressing portion 1B, wherein steps 144–151 for the third load 11B and compressing portion 1B are similar to steps 126–133 for the first load 11 and compressing portion 1. If the refrigerant temperature TH3 of compressing portion 1B is judged to be higher than or equal to the maximum temperature Ta, step 151, the heating of the third load 11B is stopped, steps 148–150. If the refrigerant temperature TH3 is judged to be lower than the maximum temperature Ta, step 151, the third load 11B is heated, steps 146–147. When the heating of the third load 11B is judged as being stopped, step 144, the third load 11B is heated, steps 146–147, if the refrigerant temperature TH3 is judged to be less than or equal to the lowest temperature Tb, step 145.

As described above, depending upon the refrigerant temperature TH1, TH2, TH3 in compressing portion 1, 1A, 1B the control of the first load 11, second load 11A and third load 11B is completely performed. Following steps 147 or 150, the state of the solenoid valve control flag SVC is determined at step 152. If the solenoid valve control flag SVC is set, the operation of the solenoid valves 14, 14A, 14B, 15, 15A, 15B is controlled at predetermined periods to discharge the refrigerant from compressing portions 1, 1A, 1B at step 155. The operation of the solenoid valves 14, 14A, 14B, 15, 15A, 15B is controlled at an interval according to the compressing degree of the refrigerant at step 156. That is, if the refrigerant is highly compressed, the operation period of the solenoid valves is longer. If the pressure of the refrigerant is grown weak, their operation period is shorter. At step 157 the adjustment of the temperature hysteresis relative to the maximum temperature Ta and the lowest temperature Tb is achieved. For example, if the refrigerant is highly compressed, the temperature hysteresis is a relatively high. Otherwise if weakly compressed, the temperature hysteresis is a relatively small.

But if the solenoid valve control flag SVC is determined to have been reset, step 152, it is judged in step 153 whether the refrigerant temperature TH1 of the compressing portion is greater than or equal to the beginning temperature Tc for discharging the refrigerant of the compressing portion. If the refrigerant temperature TH1 is greater than or equal to the temperature Tc, the solenoid valve control flag SVC is set at step 154, and then steps 155–157 are performed in turn. Otherwise, if step 153 determines that the refrigerant temperature TH1 is less than the temperature Tc, steps 154 and 155 are skipped and steps 156 and 157 are performed.

Figure 4D:
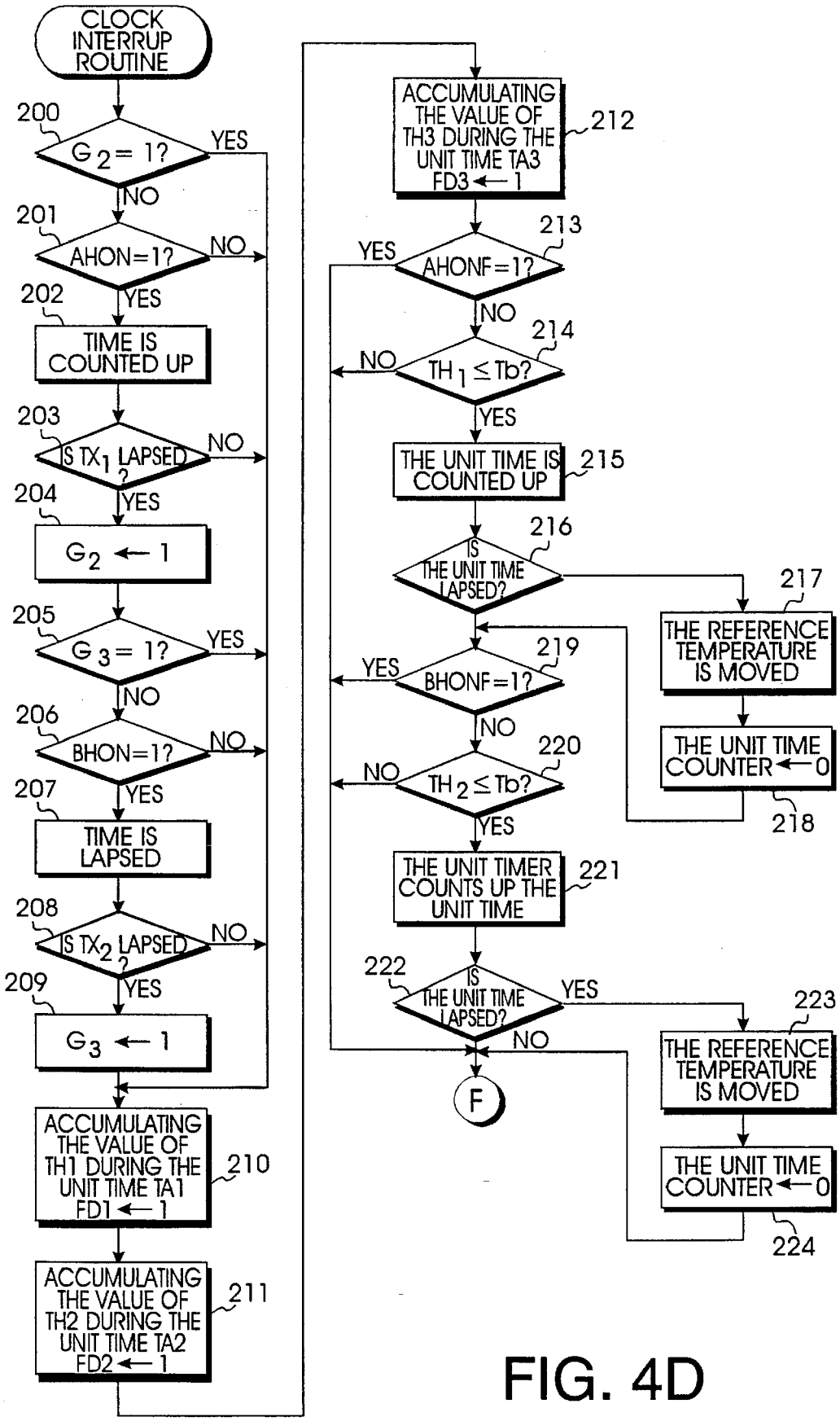
Figure 4E:
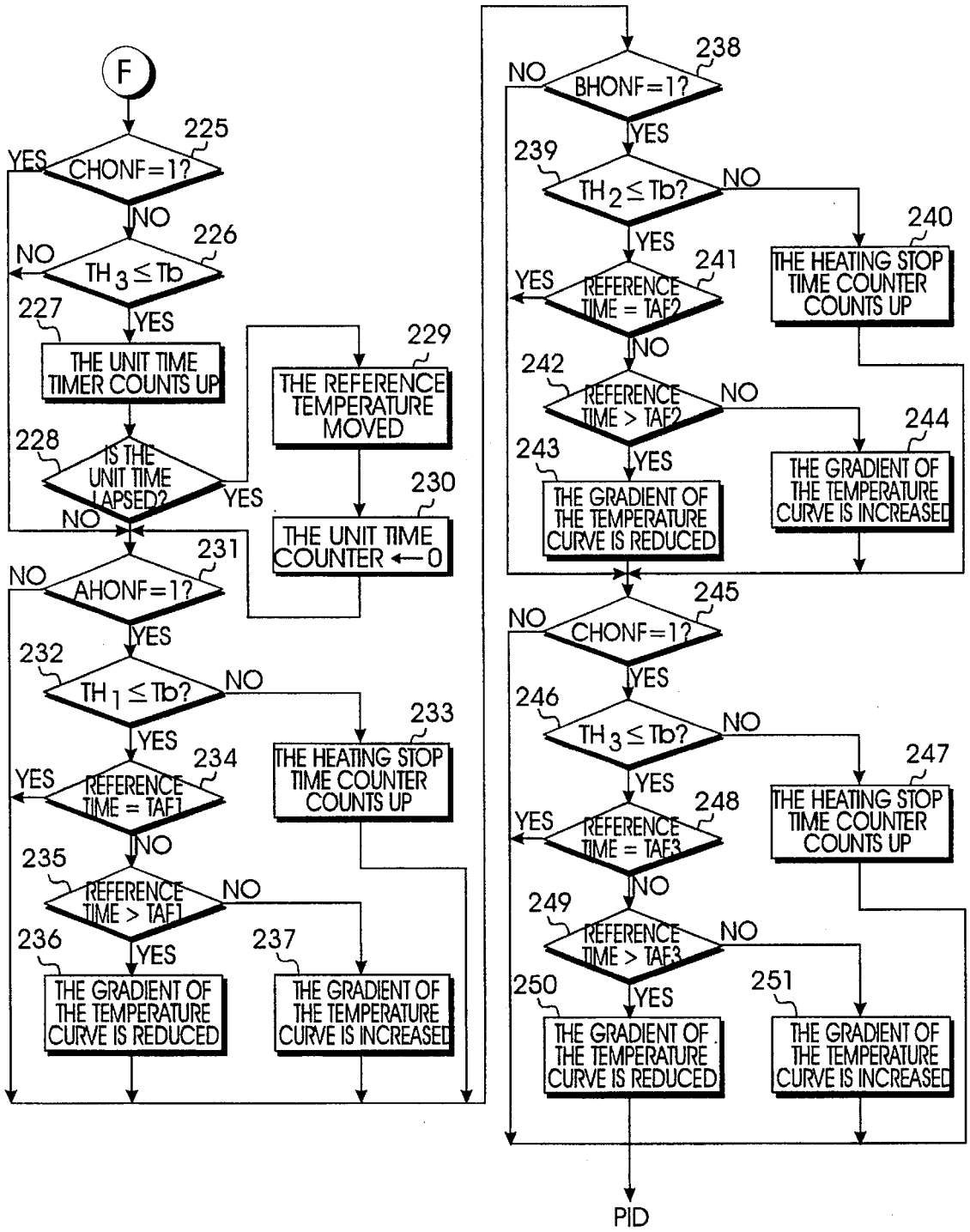

FIGS. 4D–4E represent a signal flowing view of a dock interrupt routine. In the clock interrupt routine, it is judged, FIG. 4D, in step 200 whether the time lapse flag G2 is set after the predetermined time TX1 from the start of the heating of the first load 11. If the flag G2 is set step 210 is performed. Otherwise, if the flag G2 is not set, it is judged, according to the state of the first load heating flag AHON, whether the first load 11 is being heated at step 201. If the first load 11 is being heated with the first load heating flag AHON being set, step 201 goes on to step 202 to count up the time TX1. It is judged at step 203 whether the predetermined time TX1 is lapsed. If the time TX1 is lapsed, step 203 moves into step 204 to set the time lapse flag G2. Sequentially, steps 205–209 are performed similar to steps 201–204 to count the time TX2 if the second load 11A is being heated with the second load heating flag BHON being set, step 206, and when the predetermined time TX2 is lapsed the time lapse flag G3 is set, step 209. It is desired to begin the heating of the second load after the time lapse TX1, and then to begin the heating of the third load after the time lapse TX2.

And, at steps 210 to 212, the refrigerant temperatures TH1, TH2, TH3 of the compressing portions 1, 1A, 1B, during unit times TA1, TA2, TA3, are accumulated in response to the detecting signals of the temperature detecting elements 13, 13A, 13B. After the temperature detecting flags FD1, FD2, FD3 are set, if the first load heating stop flag AHONF is not set at step 213, step 213 goes on step 214 to judge whether the refrigerant temperature TH1 of the compressing portion 1 is greater than or equal to the lowest temperature Tb. If the refrigerant temperature TH1 is greater than or equal to the lowest temperature Tb, the unit time count counts up the unit time TA1 at step 215. If the unit time TA1 is lapsed, step 216, the reference temperature which is changed per a unit time in approximation to the temperature established in the memory of the microcomputer 20 is moved at step 217. Then, at next step 218, the unit time counter is reset. Similarly, at steps 219 to 224, and steps 225–230, FIG. 4E, the unit time counter counts up the unit times Ta2, TA3 in turn, if the second and third load heating stop flags BHONF, CHONF is not set and the refrigerant temperatures TH2 and TH3 are greater than or equal to the lowest temperature Tb. According to the lapse of the unit times TA2 and TA3, the reference temperatures are shifted respectively and then the unit time counter is reset. In other words, at steps 213 to 218, steps 219 to 224 and steps 225 to 230, the temperature value is changed per the unit times TA1, TA2, TA3, which must be increased during the unit time TA1, TA2, TA3 until the heater 11 raises the refrigerant temperatures up to the maximum temperature Ta after beginning to be heated.

And then, at step 232, it is judged whether the refrigerant temperature TH1 is below the lowest temperature Tb if the first load 11 is determined to be stopped, step 231, with the first load heating stop flag AHONF being set. If the temperature TH1 is greater than or equal to the lowest temperature Tb, the heating stop time is counted at step 233. When the temperature TH1 is below the lowest temperature Tb, step 232, the reference time is compared with the temperature falling time TAF1 which the heating stop time counter counts at steps 234 and 235. If the reference time is same as the temperature falling time TAF1, the gradient of the temperature rising curve called as the predetermined temperature curve below is originally maintained with the temperature rising curve being memorized in the microcomputer 20. If the falling time TAF1 is smaller than the reference time, the gradient of the temperature rising curve is reduced downward at step 236. Otherwise the gradient is increased at step 237. Similarly the counter counts the heating stop time at steps 238 to 244 and steps 245 to 251 unit the refrigerant temperatures TH2, TH3 of the compressing portions 1A, 1B below the lowest temperature Tb, if the second and third load heating stop flags BHONF, CHONF are set. Then the counted temperature falling times TAF2, TAF3 are respectively compared with the reference time. If the falling time is same as the reference time, the temperature rising curve is originally kept. If the falling time is smaller than the reference time, gradient of the temperature rising curve us decreased. Otherwise the gradient is increased.

In other words, through steps 231 to 237, steps 238 to 244 and steps 245 to 251, the temperature falling times TAF1, TAF2, TAF3 are counted when the refrigerant temperatures TH1, TH2, TH3 are reached to the lowest temperature Tb after the heating stop of the first load 1, second load 1A, and third load 1B. The gradient of the temperature rising curve is adjusted depended upon the temperature falling time TAF1, TAF2, TAF3 to control the operation of the compressing portions 1, 1A, 1B at an interval period.

Figure 4F:
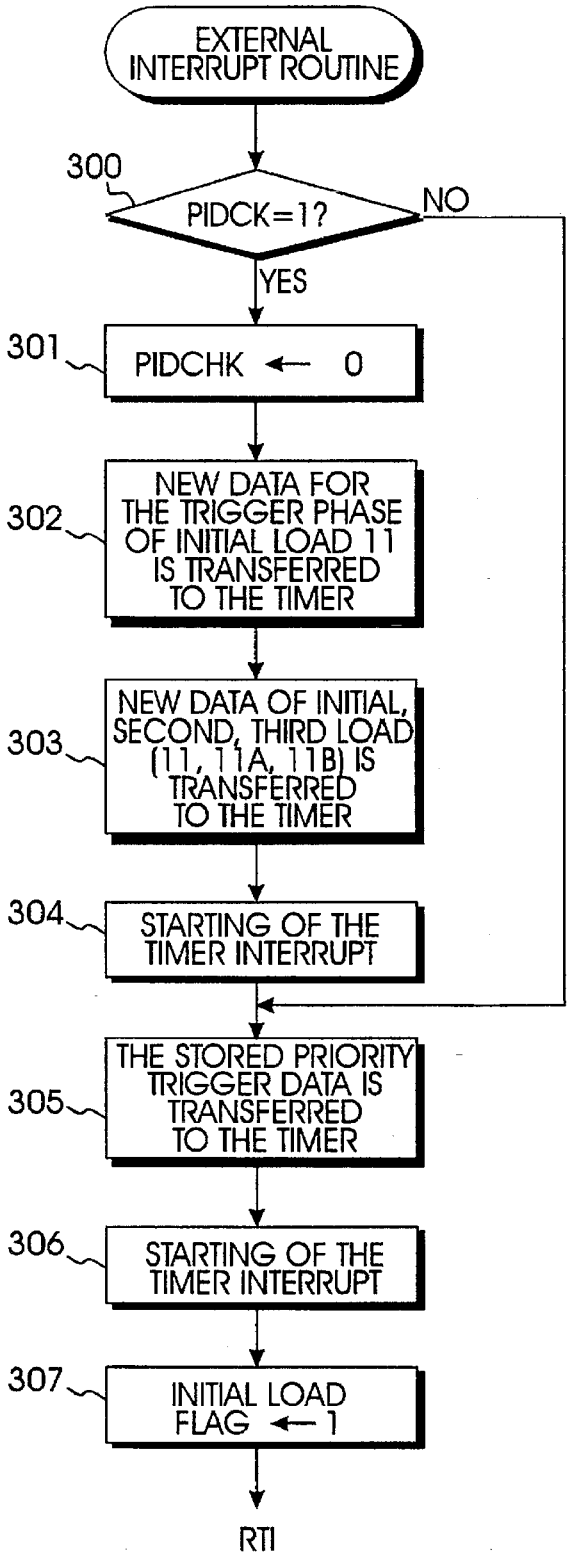

FIG. 4F is a view showing the signal flow of the external interrupt routine. In the external interrupt routine, it is judged, at step 300, whether the phase data detecting flag PIDCHK is set. If set, the phase data detecting flag PIDCHK is reset at step 301. Next the new data including the trigger phase of the first load 11 is transferred to the inner timer at step 302. The new data including the trigger phases of the first load 11, second load 11A and third load 11B is stored as the timer data at step 303. Step 303 goes on step 304 to start the timer interrupt. Only if the timer interrupt is started at step 304 or the phase data detecting flag PIDCHK is not set, the stored data of the priority trigger phase is transferred as the timer data to the timer at step 305. The timer interrupt is started at step 306 and the flag of the first load 11 is set at step 307.

Figure 4G:
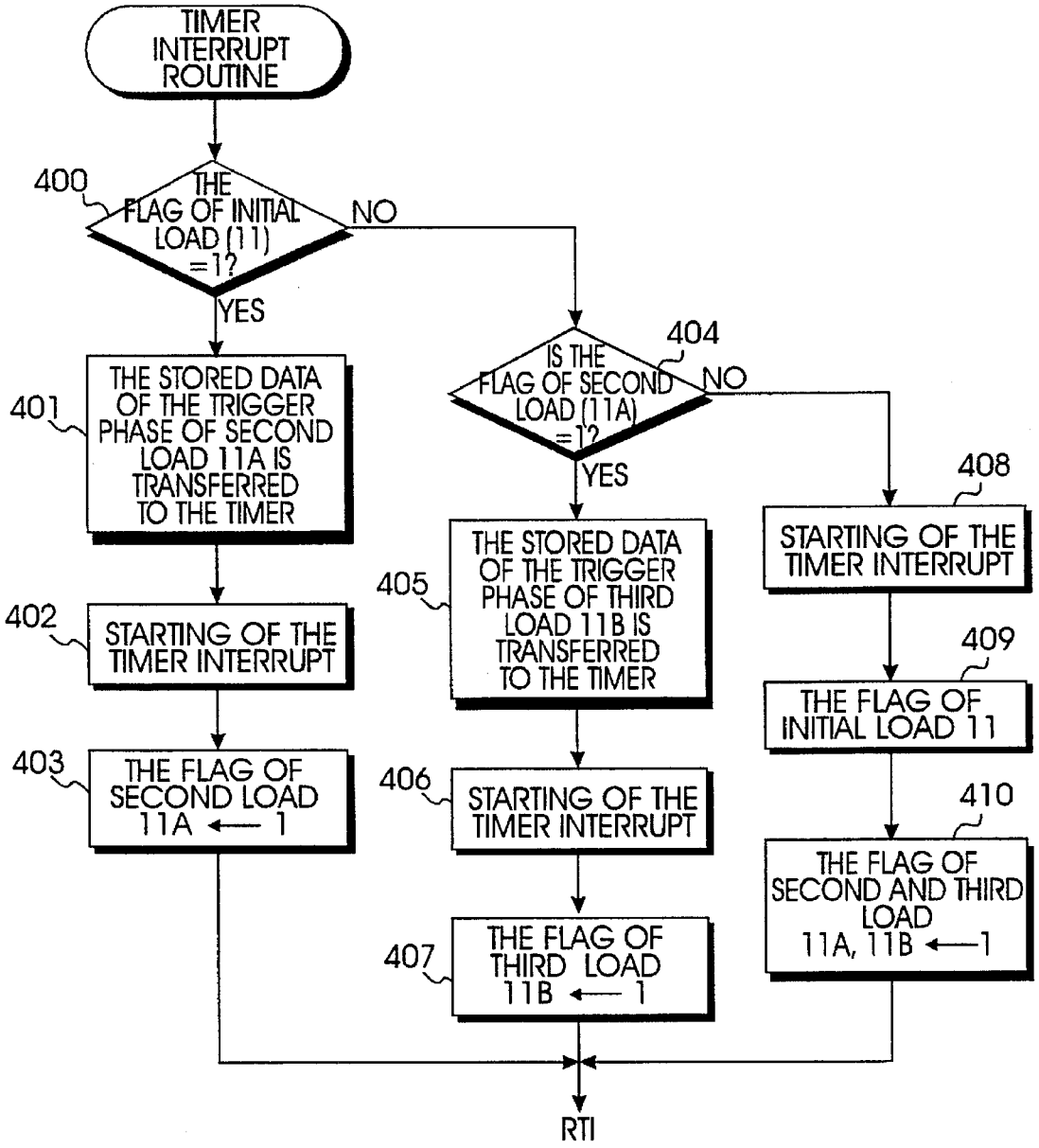

FIG. 4G is a flow chart of the timer interrupt routine. It is judged whether the flag of the first load 11 is set at step 400. If being set, the stored data of the trigger phase with respect to the second load 11A is transferred to the timer at step 401. The timer interrupt is started at step 402. The flag of the second load 11A is set at step 403. If the flag of the first load 11A is not set at step 400, step 400 goes on step 404 to determine whether the flag of the second load 11A is set. If the flag is set, the stored data of the trigger phase with resect to the third load 11B is transferred to the timer at step 405. The timer interrupt is started at step 406. The flag of the third load 11B is set at step 407. If the flag of the third load 11B is not set, the timer interrupt is started at step 408. The flag of the first load 11 is set at step 409. The flags of the second load 11A and third lard 11B are set at step 410.

Figure 5:
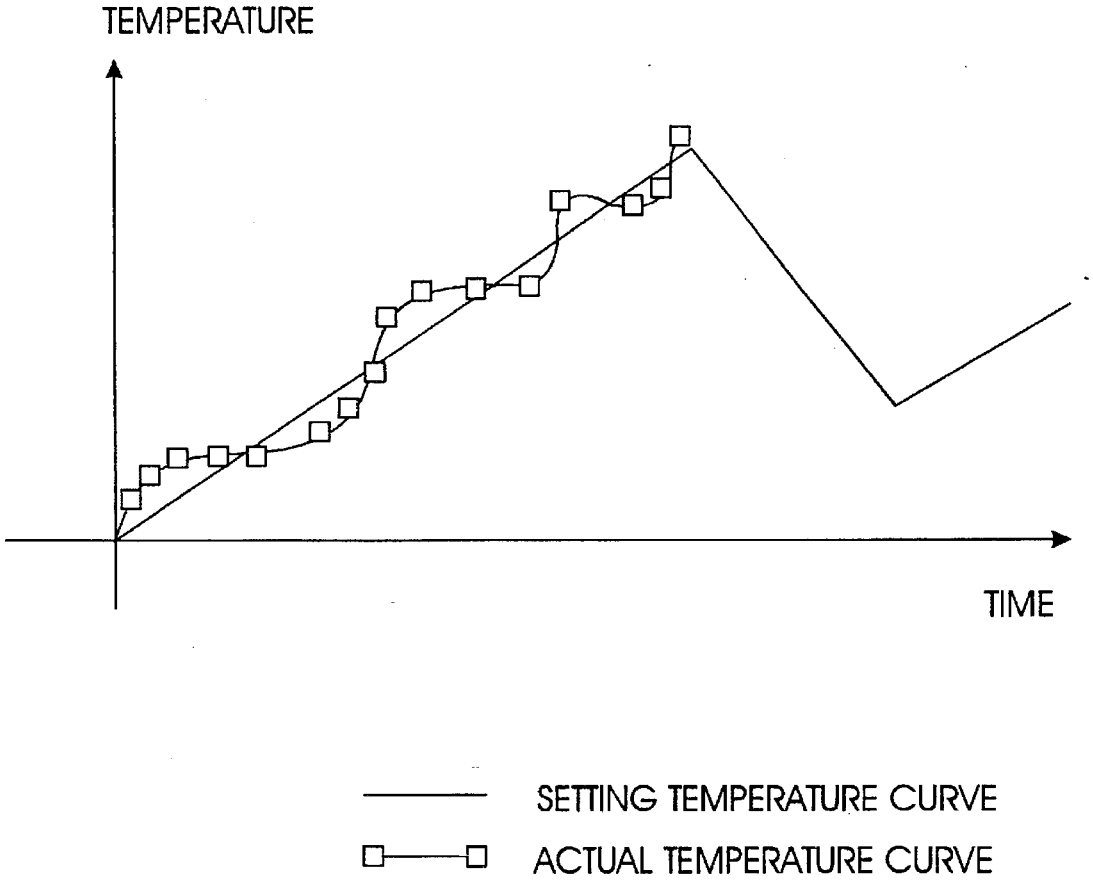
FIG. 5 is a graph illustrating the operation of the heater according to the control of the invention.

FIG. 5 is a graph showing the rising curve of the refrigerant temperatures TH1, TH2, TH3 according toe the heating of loads 11, 11A, 11B. The refrigerant temperatures TH1, TH2, TH3 of compressing portions 1, 1A, 1B are considered as the reference temperatures changing the heating temperatures of the loads per the unit time. Thus the microcomputer 20 performs the PID control according to the detected refrigerant temperatures TH1, TH2, TH3, so that the phase of the power source is controlled to reach the predetermined temperature within the predetermined period.

As described above, the invention has various effects as follows: It is easy to change the compressing force of the refrigerant. The compressing force is relatively high and the compressing efficiency is enhanced. The refrigerant is not reversely flown nevertheless the difference of the thermal conductivity but also the compressed refrigerant is smoothly circulated through the freezing cycle. Also the invention does not require a separate tank for storing the refrigerant, so that its volume is small and its installation is easy.

The preferred embodiment has been described in the foregoing description, but to one skilled in the art, various modification can be made without deviating from the scope of present invention. For example, the electronic compressing apparatus could utilize water and lithium bromide as the refrigerant absorbent combination.

What is claimed is:

1. An electronic refrigerant compressing apparatus for use in a refrigeration system having a condensor for receiving vapor and an evaporator for outputting saturated vapor during a cooling operation, said electronic refrigerant compressing apparatus comprising:

a plurality of compressing portions coupled in parallel to one another for sequentially and repeatedly heating and cooling refrigerant circulating in a refrigerant cycle, each of said compressing portions comprising:

a cylindrical body having the refrigerant charged therein, and a refrigerant pipe having the refrigerant charged therein, said refrigerant pipe being coiled around said cylindrical body;

a plurality of refrigerant heating loads respectively mounted close to each of said refrigerant pipes so as to enable generation vapor by increasing the temperature and pressure of the refrigerant during respective compression operations by each of said compressing portions;

respective solenoid valves mounted at respective outlets of each of the of the compressing portions for outputting said vapor, each respective outlet of the compressing portions being connected through a respective insulation means to the respective solenoid valve, wherein said solenoid valves are opened/closed according to the control of a microcomputer;

means for detecting the temperature of the refrigerant in said cylindrical body of each of said compressing portions for generating a signal indicative of the detected temperature, said signal being utilized by said microprocessor to control said solenoid valves;

each of said compressing portions having a respective inlet side connected through a respective check valve which controls input of the saturated vapor into each respective compressing portion for recharging said compressing portions with said refrigerant;

a refrigerant output portion mounted to each outlet of the compressing portions to enable said vapor output through said solenoid valves to be supplied to a single input of the condenser; and said microcomputer controlling the operations of the solenoid valves and the operations of the heating loads in dependence upon said signal generated by said means for detecting the temperature so that each of said compressing portions sequentially perform their respective compressing operation.

2. A method for controlling an electronic refrigerant compressing apparatus having a plurality of compressing portions each comprising a cylindrical body having the refrigerant charged therein and a refrigerant pipe having the refrigerant charged therein, said refrigerant pipe being coiled around said cylindrical body, said method comprising the steps of:

sequentially operating each of a plurality of loads, each load of said plurality of loads being wound around a respective one said cylindrical bodies of said plurality of compressing portions, at a first interval to heat the refrigerant in said cylindrical bodies and said refrigerant pipes for increasing the refrigerant pressure;

detecting the temperature of the heated refrigerant based on detecting signals from a temperature detecting sensor;

stopping the heating of the loads in turn, respectively, when the refrigerant temperature is increased up to a first temperature;

opening a solenoid valve of the cylindrical body of a first one of said compressing portions when the temperature of the refrigerant reaches a second temperature lower than said first temperature, so that the refrigerant compressed in the cylinder is circulated into a cycle of a refrigeration system;

closing the solenoid of the cylindrical body of the first one of said compressing portions while the load is being stopped;

opening the solenoid valve at the outlet of the refrigerant pipe of the first one of said compressing portions after said load has been stopped to circulate the refrigerant compressed in the pipe into the cycle of the refrigeration system;

opening a solenoid valve of the cylindrical body of a next one of said compressing portions when the temperature of the refrigerant reaches said second temperature, so that the refrigerant compressed in the cylinder is circulated into said cycle of the refrigeration system;

closing the solenoid of the cylindrical body of the next one of said compressing portions while its respective load is being stopped;

opening the solenoid valve at the outlet of the refrigerant pipe of the next one of said compressing portions after said respective load has been stopped to circulate the refrigerant compressed in the pipe into the cycle of the refrigeration system;

introducing the refrigerant again into the cylindrical bodies and the refrigerant pipes and repeating the operation as described above; and repeating the heating/cooling of the refrigerant at the first interval in each of compressing portions, thereby enhancing the compressing efficiency to obtain the refrigerant compressed at a high pressure.

3. A method as claimed in claim 2, further comprised of changing the refrigerant compressing force according to a discharging cycle of each of the compressing portions and the differences between a compressing maximum temperature and a compressing minimum temperature.

4. A method as claimed in claim 2, further comprised of controlling heating caloric amount of the loads with a proportional integral derivative operation of a microcomputer to adjust the rise and drop of the refrigerant temperature, and thereby discharging and/or cutting off the refrigerant from the body of the compressing portions and the refrigerant pipes.

5. An electronic refrigerant compressor, comprising:

a plurality of compressing means coupled in parallel, for heating and cooling a refrigerant, wherein each of said compressing means comprises:

a cylindrical body charged with the refrigerant;

a refrigerant pipe coiled around said cylindrical body and charged with the refrigerant;

means for heating the refrigerant stored in the cylindrical body and the refrigerant pipe;

temperature determining means determining the temperature of the refrigerant stored in the cylindrical body, said temperature determining means coupled to a side of the cylindrical body;

a plurality of solenoid valves for controlling the discharging of the refrigerant from each of the compressing means;

output means for transferring the refrigerant from each of the compressing means; and flow control means for controlling the flow of the refrigerant into each of the compressing means, the flow of the refrigerant into the compressing means being for recharging each of said compressing means.

6. The electronic refrigerant compressor of claim 5, further comprising means for controlling the heating means and the solenoid valves, in dependence upon a signal from the temperature determining means, wherein each of the compressing means performs a compressing operation sequentially.

7. The electronic refrigerant compressor of claim 5, further comprising means for preventing heat transfer between each of the compressing means and the output means, and means for preventing heat transfer between each of the compressing means and the flow control means.

8. A process for controlling an electronic refrigerant compressor, comprising:

heating a refrigerant stored in a first cylindrical body and a first refrigerant pipe, wherein the first cylindrical body and first refrigerant pipe comprise a first compressing portion;

determining the temperature of the refrigerant in the first cylindrical body;

when said temperature reaches a first temperature, discharging the refrigerant in the first cylindrical body into a refrigerant output area;

after a first period of time has passed, discontinuing the discharging of the refrigerant from the first cylindrical body to the refrigerant output area, and discontinuing the heating of the refrigerant;

discharging the refrigerant in the first refrigerant pipe into the refrigerant output area;

transferring the refrigerant from the refrigerant output area to a condenser;

transferring the refrigerant from the condenser through a capillary tube to an evaporator;

transferring the refrigerant from the evaporator to inlets for the first compressing portion; controlling direction of flow of the refrigerant into the first compressing portion by check valves; and repeating the process as described above.

9. The process of claim 8, further comprising:

when the first temperature is reached, heating the refrigerant stored in a second cylindrical body and a second refrigerant pipe, wherein the second cylindrical body and the second refrigerant pipe comprise a second compressing portion, and said second compressing portion is coupled in parallel with said first compressing portion;

determining the temperature of the refrigerant in the second cylindrical body;

when the temperature of the refrigerant in the second cylindrical body reaches a second temperature, discharging the refrigerant in the second cylindrical body into the refrigerant output area;

after a second period of time has passed, discontinuing the discharging of the refrigerant from the second cylindrical body to the refrigerant output area, and discontinuing the heating of the refrigerant in the second compressing portion;

discharging the refrigerant in the second refrigerant pipe into the refrigerant output area;

transferring the refrigerant from the refrigerant output area to said condenser;

transferring the refrigerant from the condenser through the capillary tube to the evaporator;

transferring the refrigerant from the evaporator to inlets for the compressing portions; and controlling direction of flow of the refrigerant into the compressing portions.

10. The process of claim 9, further comprising:

when the second temperature is reached, heating the refrigerant stored in a third cylindrical body and a third refrigerant pipe, wherein the third cylindrical body and the third refrigerant pipe comprise a third compressing portion, and said third compressing portion is coupled in parallel with said first compressing portion and said second compressing portion;

determining the temperature of the refrigerant in the third cylindrical body;

when the temperature of the refrigerant in the third cylindrical body reaches a third temperature, discharging the refrigerant in the third cylindrical body into the refrigerant output area;

after a third period of time has passed, discontinuing the discharging of the refrigerant from the third cylindrical body to the refrigerant output arcs, and discontinuing the heating of the refrigerant in the third compressing portion;

discharging the refrigerant in the third refrigerant pipe into the refrigerant output area;

transferring the refrigerant from the refrigerant output area to the condenser;

transferring the refrigerant from the condenser through the capillary tube to the evaporator; and transferring the refrigerant from the evaporator to inlets for the compressing portions.

* * * * *